US008425384B2

(12) United States Patent
Garner

(10) Patent No.: US 8,425,384 B2
(45) Date of Patent: Apr. 23, 2013

(54) MULTI-LINK EXERCISE MACHINE

(75) Inventor: Brian Garner, Waco, TX (US)

(73) Assignee: Baylor University, Waco, TX (US)

( * ) Notice: Subject to any disclaimer, the term of this patent is extended or adjusted under 35 U.S.C. 154(b) by 0 days.

(21) Appl. No.: 11/365,385

(22) Filed: Mar. 1, 2006

(65) Prior Publication Data

US 2006/0148625 A1 Jul. 6, 2006

Related U.S. Application Data

(63) Continuation-in-part of application No. 10/966,010, filed on Oct. 15, 2004, now abandoned.

(51) Int. Cl.
*A63B 21/00* (2006.01)
*A63B 21/068* (2006.01)

(52) U.S. Cl.
USPC ..... 482/92; 482/95; 482/96; 482/133; 482/135; 482/136

(58) Field of Classification Search ..... 482/92, 482/112, 123, 129, 130, 905, 32, 95, 96, 482/133, 135, 136, 137, 142
See application file for complete search history.

(56) References Cited

U.S. PATENT DOCUMENTS

| | | | | |
|---|---|---|---|---|
| 2,145,940 | A | | 2/1939 | Marlowe |
| 4,275,882 | A | | 6/1981 | Grosser et al. |
| D271,603 | S | | 11/1983 | Berner |
| 4,426,077 | A | | 1/1984 | Becker |
| 4,429,871 | A | | 2/1984 | Flechner |
| 4,477,071 | A | | 10/1984 | Brown et al. |
| 4,618,140 | A | | 10/1986 | Brown |
| 4,618,144 | A | | 10/1986 | Gibson |
| 4,621,620 | A | * | 11/1986 | Anderson ..... 601/34 |
| 4,627,610 | A | | 12/1986 | Ishida et al. |
| 4,786,051 | A | | 11/1988 | Mullican |
| 4,880,227 | A | | 11/1989 | Sowell |
| 4,915,378 | A | * | 4/1990 | Abrahamian et al. ..... 482/137 |
| 5,031,905 | A | | 7/1991 | Walsh |
| 5,037,090 | A | | 8/1991 | Fitzpatrick |
| 5,058,888 | A | | 10/1991 | Walker et al. |
| 5,277,674 | A | * | 1/1994 | Tsuchiya et al. ..... 482/8 |
| 5,277,684 | A | | 1/1994 | Harris |
| 5,352,171 | A | | 10/1994 | Lin |
| 5,419,750 | A | | 5/1995 | Steinmetz |
| 5,453,066 | A | | 9/1995 | Richter |
| 5,527,243 | A | * | 6/1996 | Chen ..... 482/72 |
| 5,527,250 | A | * | 6/1996 | Chen ..... 482/96 |

(Continued)

OTHER PUBLICATIONS

Zajac, Felix E., "Muscle and Tendon: Properties, Models, Scaling, and Application to Biomechanics and Motor Control," Critical Reviews in Biomedical Engineering, vol. 17, Issue 4 (1989), pp. 359-411.

*Primary Examiner* — Loan Thanh
*Assistant Examiner* — Sundhara Ganesan
(74) *Attorney, Agent, or Firm* — Jackson Walker, LLP

(57) ABSTRACT

An exercise machine which includes a frame which is connected to a series of pivotable links. A user sits on one of the links and applies force, typically with his legs, to a drive link. At least two of the links are connected by some form of resistance, such as hydraulic cylinder. When the user presses against one of the links, resistance is applied, through the links, by the weight of the user and the hydraulic cylinder.

17 Claims, 7 Drawing Sheets

U.S. PATENT DOCUMENTS 5,531,658 A * 7/1996 Liao ..... 482/142
5,554,086 A * 9/1996 Habing et al. ..... 482/137
5,605,524 A 2/1997 Husted
5,665,034 A 9/1997 Hwang
5,672,142 A * 9/1997 Wu ..... 482/96
5,685,810 A 11/1997 Chung
5,743,832 A 4/1998 Sands et al.
5,785,635 A 7/1998 Gerschefske et al.
6,162,153 A * 12/2000 Perez et al. ..... 482/96
6,264,588 B1 * 7/2001 Ellis ..... 482/137
6,287,241 B1 * 9/2001 Ellis ..... 482/96
6,290,630 B1 9/2001 Boland
6,394,938 B1 * 5/2002 Tornabene ..... 482/142
6,544,151 B2 * 4/2003 Tornabene ..... 482/122
6,605,024 B2 * 8/2003 Stearns ..... 482/142
6,743,158 B2 * 6/2004 Giannelli et al. ..... 482/96
2002/0193210 A1 12/2002 Turner
2003/0158018 A1 * 8/2003 Giannelli et al. ..... 482/95
2005/0032611 A1 * 2/2005 Webber et al. ..... 482/72

* cited by examiner

MULTI-LINK EXERCISE MACHINE

This application is a continuation-in-part of and claims priority to U.S. patent application Ser. No. 10/966,010, entitled "A Variable Resistance Flexion and Extension Exercise Machine," filed on Oct. 15, 2004 now abandoned, the entire content of which is hereby incorporated by reference.

FIELD OF THE INVENTION

Exercise machines, more specifically an exercise machine with a combination of links that allows an effort force, variable over a range of movement, to be counteracted by a resistance force with a similar variation.

BACKGROUND OF THE INVENTION

Often, exercise machines, including those that have linkages that vary the resistance force applied to the user, provide a resistance force to the user's applied force, which resistant force is either linear or is not balanced against the effort force of the user. In some exercises, such as leg presses, the upper leg bone and the lower leg bone initially proscribe a fairly narrow angle, with the knee at the apex. During the leg press, the muscle operates to flex the lower leg away from the upper leg and to increase the angle between the two, at the knee. However, as the angle between the upper and lower leg at the knee changes, the user gets better leverage from the muscles involved and can apply greater effort force.

All machines would have balance between resistance force and user's effort force (by laws of physics), but not necessarily the user's maximum effort force. Applicant seeks to balance resistance to the strength of the user so as to effect optimal exercise over the entire range of motion. In the leg press, for example, the motion ranges from a position of high knee flexion (narrow angle between shank and thigh) to a position of full knee extension (zero knee flexion, corresponding to 180 degree angle between shank and thigh). It happens that the capacity of the user to generate force, due to muscle leverage, increases dramatically as the knee moves towards full extension.

It is often advantageous to have an exercise machine, including, for example, a leg press machine in which the resistance force (the force opposing the applied force that the exercise user places on the machine) also increases as, for example, the leg angle of the user increases.

It is advantageous, for the sake of optimizing exercise benefits, to provide a resistance which varies with the strength (i.e., the maximum effort capacity) of the joint as the joint position varies. For the leg press, this would mean that the machine resistance also increases as the leg position moves towards knee extension.

OBJECTS OF THE INVENTION

It is an object of the present invention to provide an exercise machine, including a leg press machine or an arm press machine, in which the resistance force varies, proportionately with strength here typically increases, as a drive lever of the multi-link machine is moved.

It is another object of the present invention to provide a variable resistance exercise machine where the user's application of muscular force (effort) to a drive lever results in a resisting reaction force generated by a mechanical device, such as a hydraulic cylinder, and possibly a component of the user's own weight.

It is yet another object of the present invention to provide an exercise machine with a multiplicity of links, wherein the application of a force to a drive link of the multiplicity of links causes the user to be lifted vertically, to some degree, against the force of gravity move vertically.

It is another object of the present invention to provide a multi-link exercise machine wherein the mechanical resistance of the assembly has a mechanical advantage that may be selectively changed so that a drive link of the multi-link system may have a variable mechanical advantage.

It is yet another object of the present invention to provide a leg press machine having a foot pad, the foot pad having a multiplicity of adjustable positions or size settings, which permit selective adjustment of the drive lever range of motion relative to the user foot range of motion, and accommodating users of varying leg lengths the positions adjustable with respect to a drive lever of the machine and/or the feet of the user.

It is yet another object of the present invention to provide a leg press machine in which a hydraulic cylinder can provide, in part, resistant force to an effort applied by the user, which resistant force increases with the effort applied to and the increase in speed of the drive lever.

SUMMARY OF THE INVENTION

Applicant's invention includes a linkage system comprising a multiplicity of links. One of the links may be a drive lever that is adapted to receive an appendage of the user (foot, hands or the like) to apply an applied effort force thereto, which effort force will be resisted by a mechanical resistance assembly, with possibly an additional component of resistance generated by the user's own weight.

DETAILED DESCRIPTION OF THE PREFERRED EMBODIMENT

Figure 1:
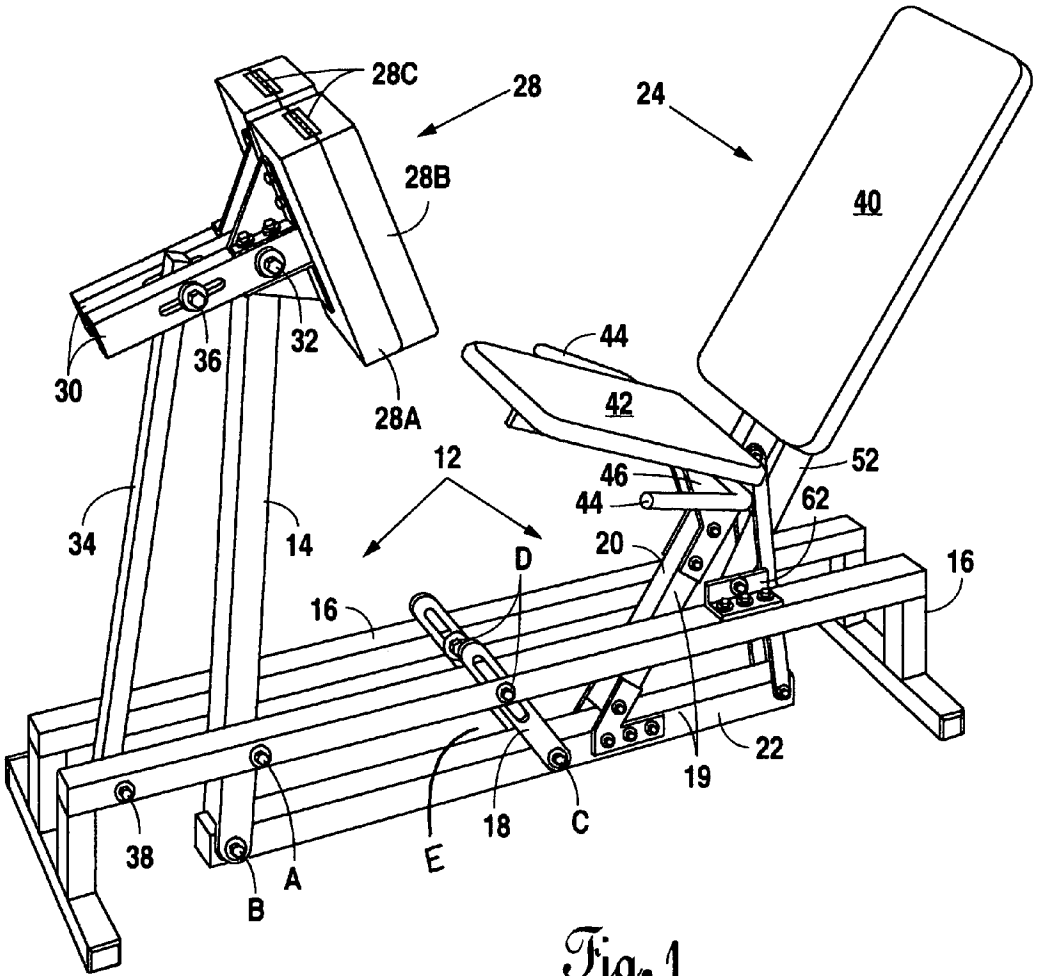
FIG. 1 is a perspective view of Applicant's multi-link exercise machine.
Figure 2A:
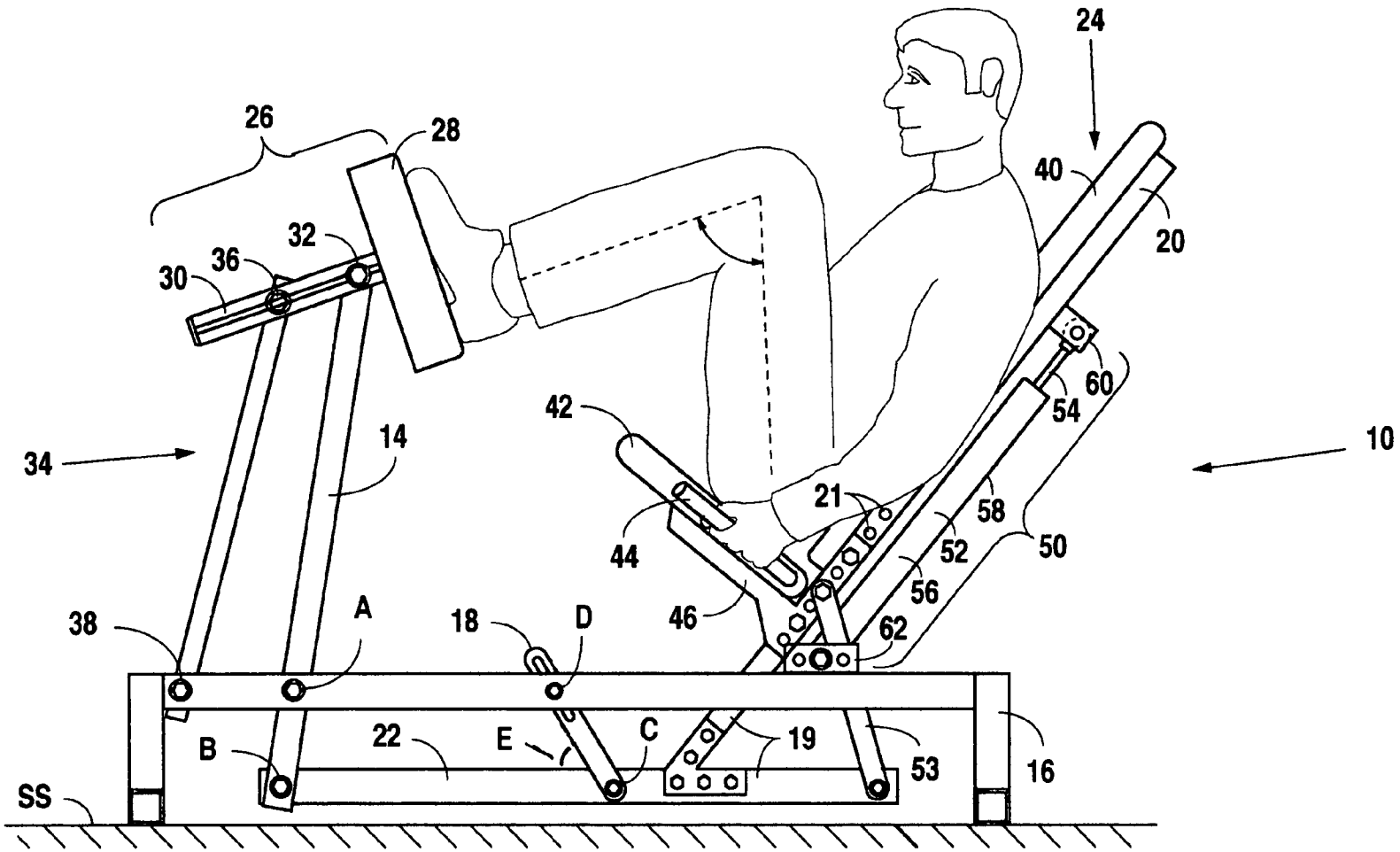
FIGS. 2A and 2B are side elevational views of Applicant's multi-link leg press exercise machine showing a user in a start position (FIG. 2A) and an extended position (FIG. 2B).
Figure 2B:
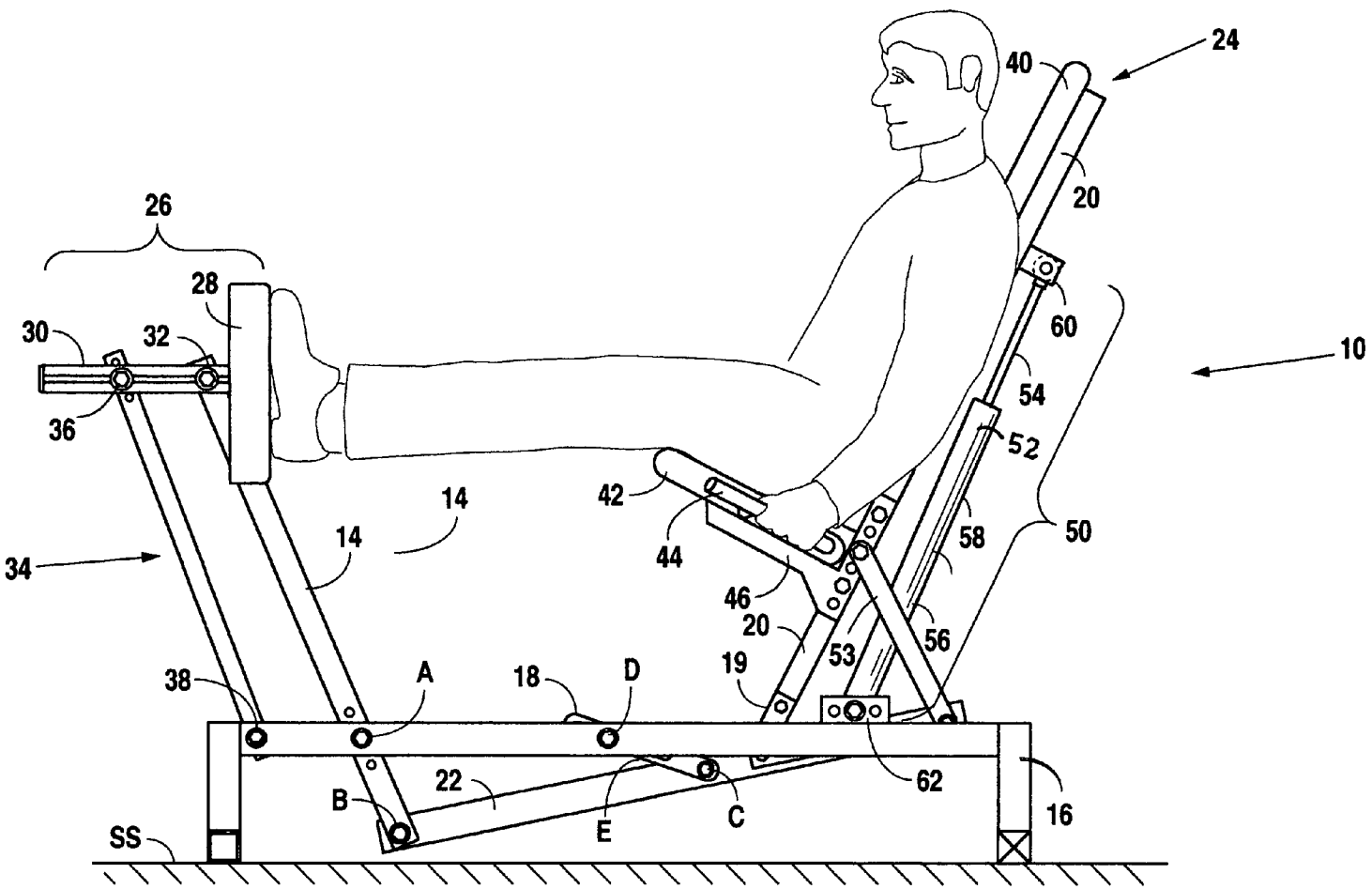

Applicant's exercise machine 10 is seen in side elevational view in FIG. 1 and with reference to FIGS. 2A and 2B, resting on support surface SS. The exercise machine 10 is comprised of a linkage system 12, the linkage system comprising a multiplicity of links, which links are typically rigid members or bars, which may be pivotable with respect to one another, but that cooperate to transmit a resistance force to a user applied effort force. As seen in FIG. 1, Applicant's multiple linkage includes a drive lever 14*a*, fixed frame 16 supported on a support surface, such as a floor of a workout room, a rocker link 18, and a seat support link 19 (comprised here of seat assembly support 20 and crossbar 22 rigidly, but adjustably, mounted to one another). Thus, this particular linkage system 12 includes four links. The drive lever 14 is pivotally attached to a floor supported fixed frame 16 at point A. A removed end of drive lever 14 is pivotally attached to seat link 19 at point B. Rocker 18 is pivotally engaged with seat link 19 at point C, and pivotally engaged to frame 16 at point D. These points may represent fasteners or other pivot or rotation means known in the trade.

Turning to FIGS. 2A and 2B, it is seen that a mechanical resistance assembly 50 engages at least two of the links of the multi-link system 12. Illustrated in FIGS. 2A and 2B, is the engagement of a mechanical assembly, here including hydraulic cylinder 52, between fixed frame 16 and seat link 19. Seat link 19 is seen to include a seat assembly 24 on which will reside at least some of the weight of the user typically in a seated position. Application of a force by the user to drive lever 14 will cause a pivoting action of the drive lever and movement of the linkage system. This movement will result in the generation of a resistance force by the mechanical resistance assembly 50 to the applied effort force of the user, as well as an additional component of resistance generated by a lifting of the user's own weight against the force of gravity over at least some range of the drive lever's pivoting motion.

A footpad assembly 26 is comprised as set forth below (of elements 28, 30, 32, 34, 36, and 38) and is adapted to easily, conveniently and effectively transmit a muscular applied effort force of the user to the drive lever. Footpad assembly 26 includes a footpad 28, which may comprise a single member or a set of members, wherein each member of the set is adapted to receive one of the two feet of the user and may have foam pads covered with a durable fabric as is known in the art. Footpad 28 may include two separate covered sections, 28*a* and 28*b*, as illustrated in FIG. 1, which sections are hinged together at 28*c* as by a fabric member. This would allow a taller user to flip footpads 28*b* on hinge 28*c* out of the way so the taller person's bottom feet would rest on 28*a*, allowing a more comfortable initial starting position for the taller user.

A support post 30, typically comprised of a pair of members, is fixedly and adjustably attached, typically through a fastener, to drive lever 14 at support post/driver lever arm pivotal attachment 32. A stay bar 34 is pivotally attached at or near one end to the frame and near another end to the support post 30. The function of the stay bar is to rotatably move the surface of the footpads as the drive lever moves along an arc that will tend to keep the feet of the user approximately perpendicular to the lower leg of the user for more comfortable and effective motion. The foot pad assembly 26 also includes a stay bar/support post pivotal attachment 36, such as a fastener. Another fastener may act as stay bar/frame pivotal attachment 38.

Seat assembly 24 functions to, among other things, support the weight of the user and allow easy access of the user to the drive lever. Seat assembly 24 is seen in FIGS. 1, 2A and 2B to comprise a back rest 40 (which may be padded), a bottom rest 42 (which may be padded), a pair of hand graspable handles 44, all engaged with seat link 19 through the use of a seat support/seat assembly adjustable bracket 46, which adjustably positions (through ways known in the trade, including a multiplicity of holes (21)) the seat assembly along seat support 20 of seat link 19. Adjustable bracket 46 may be attached to seat support 20 through the use of a multiplicity of holes (21) in the seat support and adjustable bracket, along with fasteners, such as threaded fasteners, quick pins or other means as known in the trade. Such adjustability will allow one to move the seat assembly and, therefore, the seat longitudinally along seat support 20.

Figure 3:
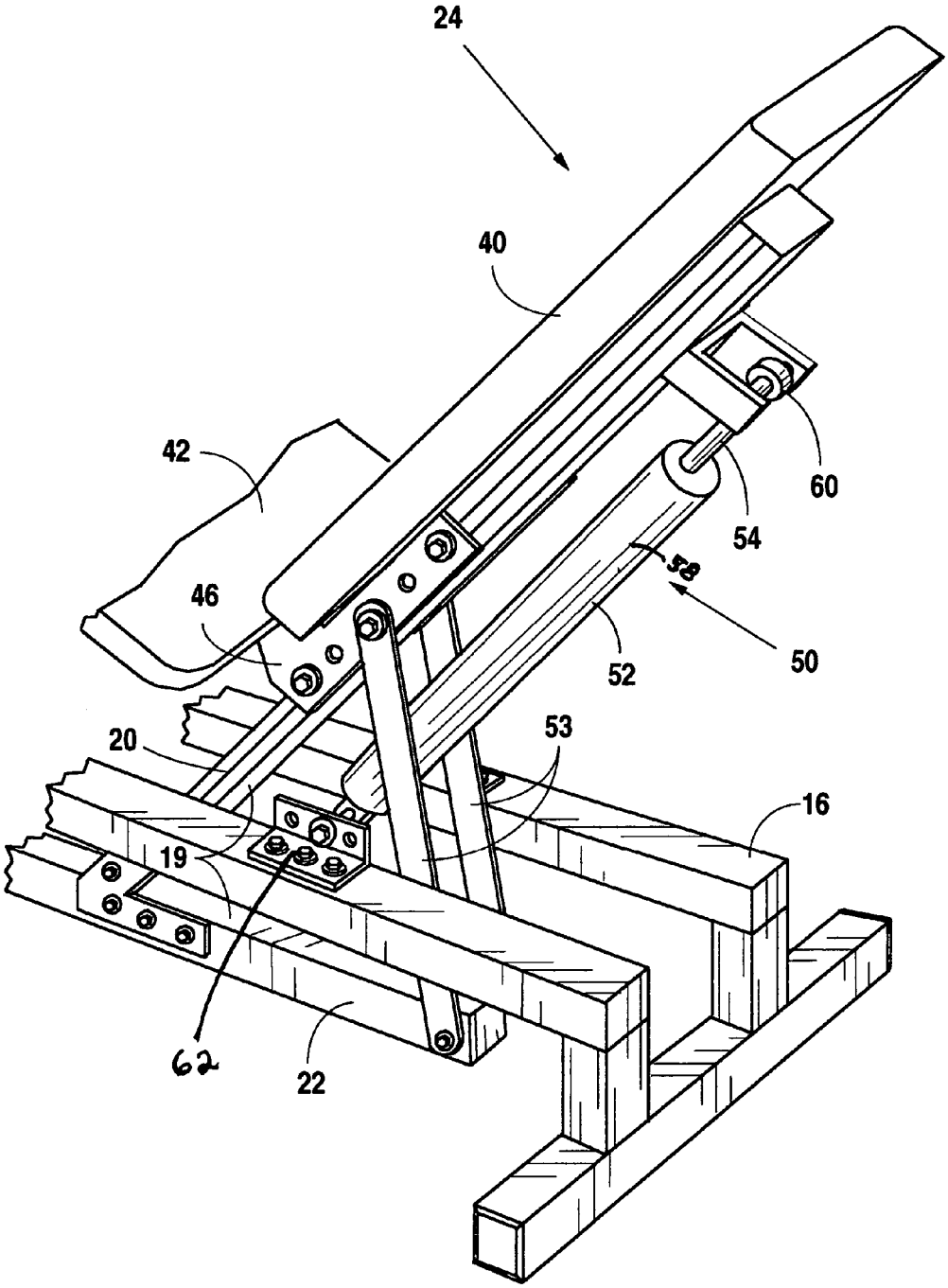
FIG. 3 is a cutaway view of a portion of Applicant's multi-link leg press machine showing the mechanical assembly thereof

Mechanical resistance assembly 50 is provided to apply a mechanical resistance to a user actuated pivoting of drive lever 14. Mechanical resistance assembly 50 may include different resistance means, for example, weights, spring (see FIGS. 3A and 3B), etc., but in FIGS. 2A, 2B and 3 is illustrated having a hydraulic cylinder 52 for resisting the user's effort force and achieving a cushioned let-down when the weight of user allows the machine to return to the lower position as set forth in FIG. 2A. The hydraulic cylinder is also "self-adjusting" in that the harder the applied force by the user, the more resistance generated. Hydraulic cylinder 52 includes a rod 54, a piston 56, the rod slideably received in a body 58, typically cylindrical, the body for enclosing piston 56, which piston typically moves within a fluid to provide a resistance to the rod proportional to the applied velocity to the rod. As can be seen in FIG. 3, hydraulic cylinder 52 engages seat link 19, here more specifically the seat support 20, at adjustable bracket 60 and the body 58, adjustably mounted, typically with a ball joint, at frame/adjustable bracket 62.

It is seen that the application of force to foot pad 28 by a seated user whose feet are placed on the pad and knees are flexed will, as the leg muscles contract, cause rotation of drive lever 14 about pivot point A, to move seat link 19. Seat link 19, however, has rocker 18 at point C, which rocker is also pivotally attached at point D to frame 16. Ignoring for a moment, the effective mechanical resistance assembly 50, it is seen that the counterclockwise movement of drive lever 14 by the feet of the user will cause the seat link 19 to raise up, lifting the user. Further, it is seen that the farther counterclockwise drive lever is pivoted, the smaller transcribed angle E, that angle between the rocker 18 and crossbar 22 as seen in FIG. 1, becomes. As this angle diminishes, the component of the user applied force that is lifting the body of the user through the linkage system increases. That is, as angle E diminishes (with increased knee extension), the component of user applied force acting to lift the user's weight through the linkage system increases. That is, the user's weight will have greater mechanical advantage to resist the user's leg press force, requiring greater force from the user, which is exactly what we need to balance the increased strength at that knee position.

The effect of the mechanical resistance assembly is to add additional resistance force to the applied force, here in the form of a hydraulic cylinder. Moreover, using the hydraulic cylinder, the faster the force is supplied to the drive lever, the greater the resistance to the lifting action (and hence movement of the rod 45 and body 58). The purpose of the hydraulic resistance force is to provide the general baseline resistance over the full range of motion. Its magnitude increases the faster the user drives the lever, and it, too, actually increases as the knee extends. However, it is insufficient to balance strength near full knee extension, and so the gravity component of resistance supplements the hydraulic resistance.

A combination of a slot and fasteners could also be used to attach the seat assembly to seat support 20.

Adjustments may be made, between A and B (or other link attachment points), for example, with the use of a series of holes in links 14 and/or 16 that will allow a shorter person to have a decreasing range of motion in the drive lever. Likewise, coupler 18 may have a slot as illustrated or a series of holes to engage frame 16.

Figure 3A:
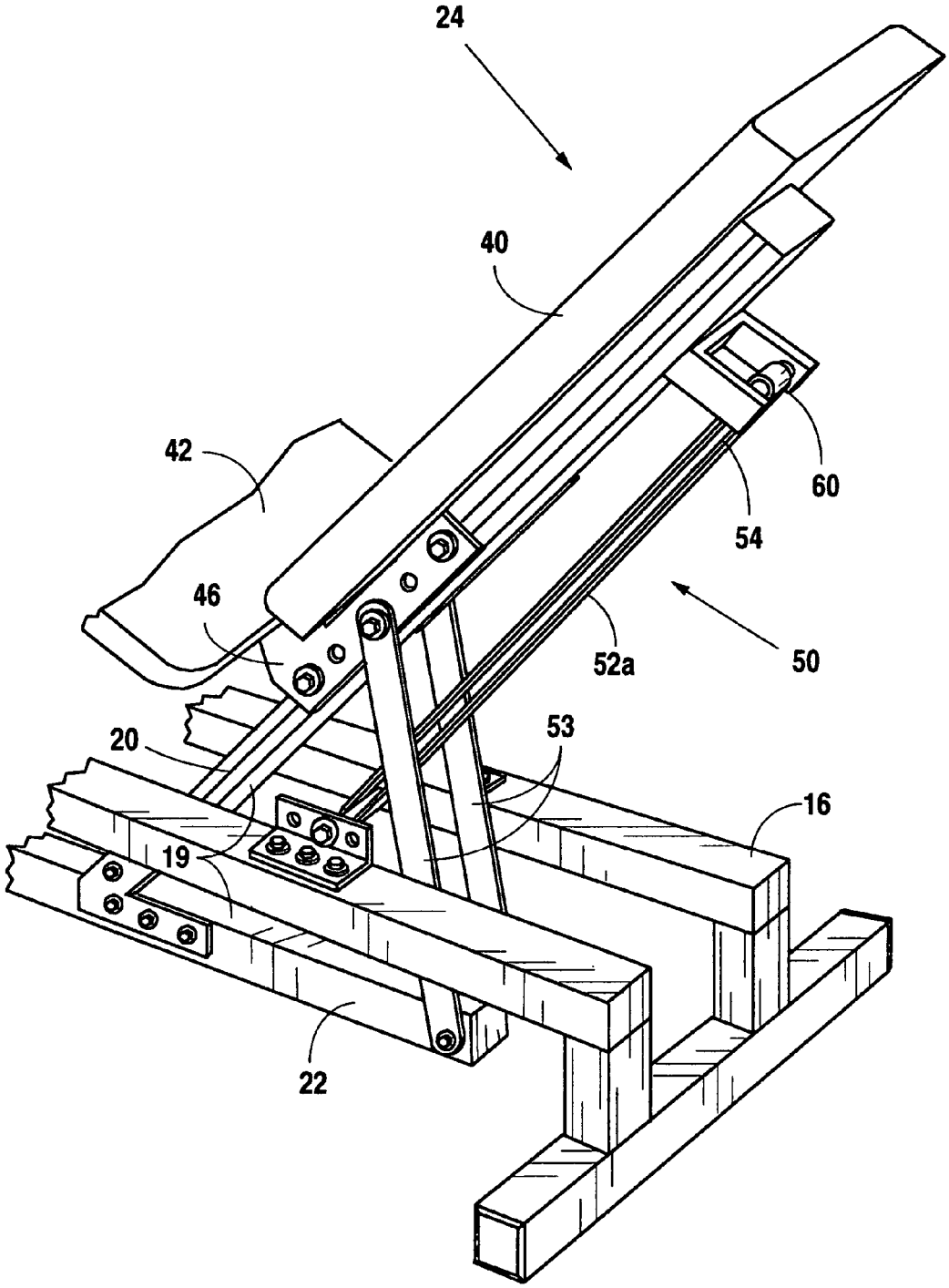
FIGS. 3A and 3B are perspective view of alternate preferred embodiments of the present invention.
Figure 3B:
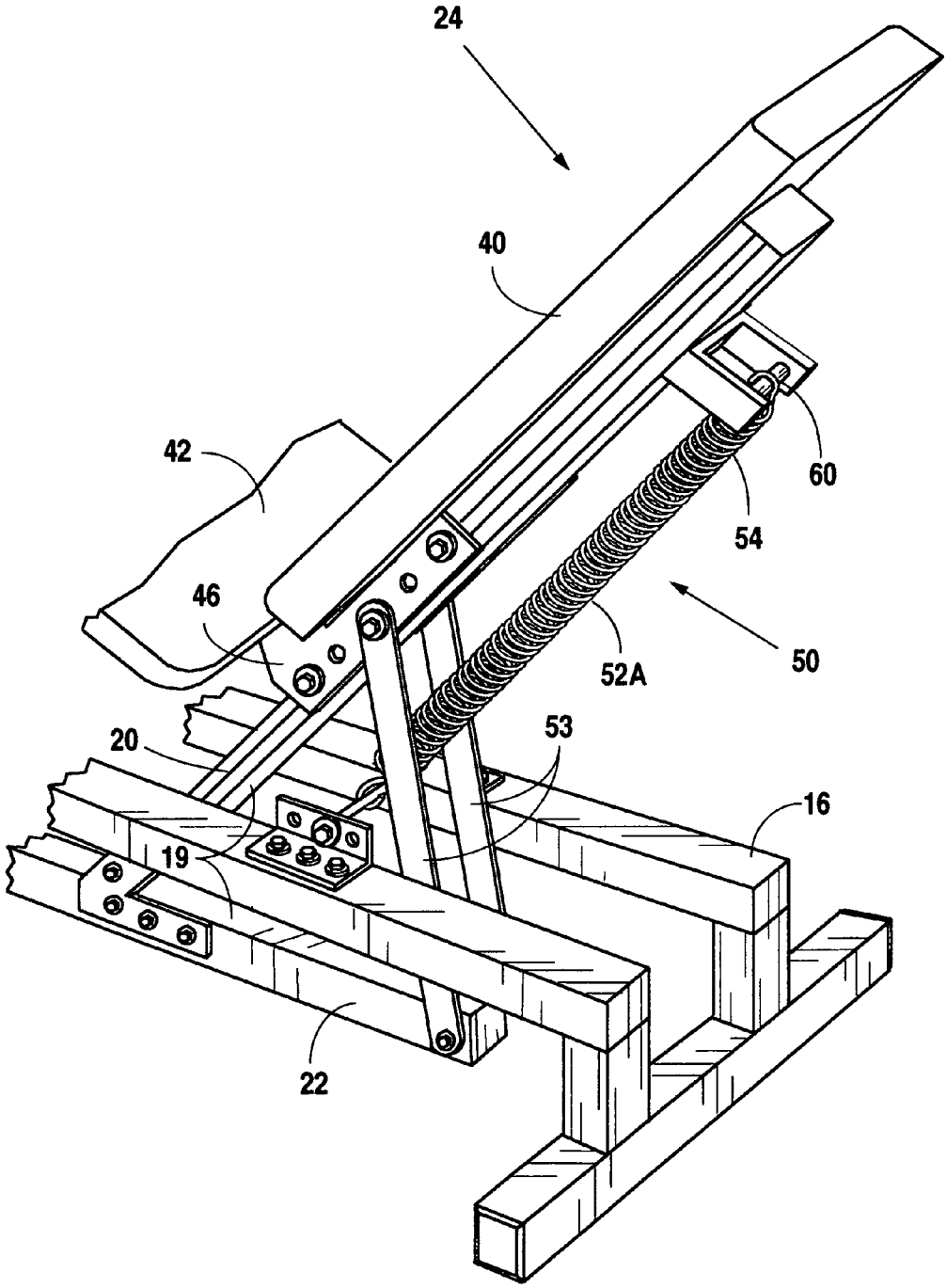

FIGS. 3A and 3B illustrate the use of the spring 52*a* or elastomeric member 52*b* for providing mechanical resistance, in place of hydraulic assembly. While the use of these different assemblies would achieve some of the results of applicant's present invention, they are not the preferred resistance assembly.

Figure 1A:
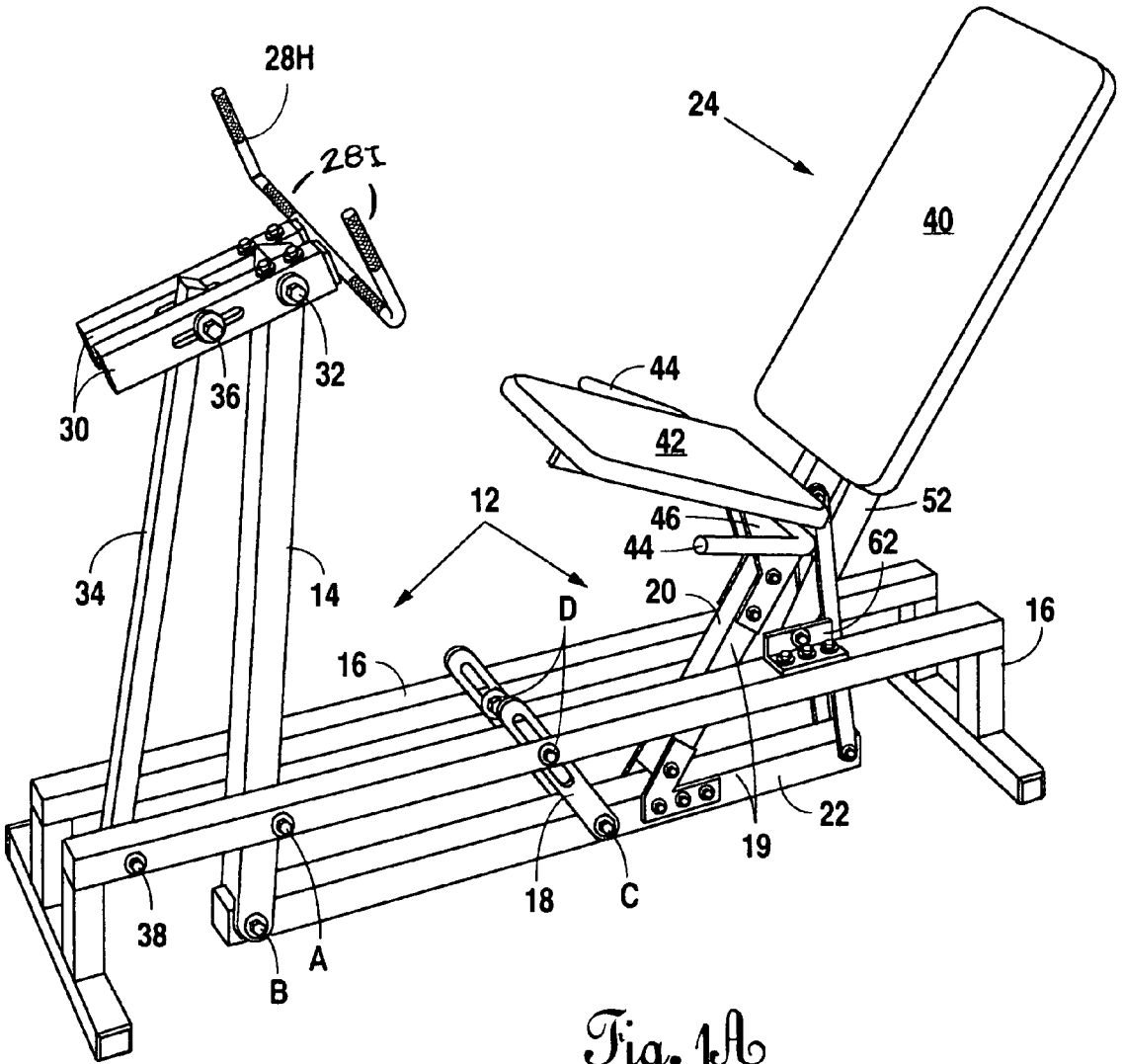
FIG. 1A is a perspective view of an alternate preferred embodiment of Applicant's invention.

FIG. 1A illustrates the use of a hand engaging handle 28H in place of footpad 28 to allow a user to use the exercise machine for seated bench press. As can be seen in FIG. 1A, there may be a number of gripping surfaces on the hand engaging member to allow the user to grip either a horizontal or vertical portion of the hand engaging member. Further, the hand engaging member may be rotatably attached to the support post and may also include rotatable hand grip portions 28I, wherein the hand grip portions rotate with respect to the rest of the hand engaging assembly in ways known in the trade, such that movement by the user of the drive lever allows rotation of the rotatable portions 28I and for comfort of the user.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An exercise machine for the limbs of a user comprising:

a linkage system with a multiplicity of links; the multiplicity of links including a drive lever, wherein the drive lever includes a foot pad having a foot engagement surface therein, the footpad for engagement of at least one foot of the user when the user is seated in a sitting position in a seat; a mechanical resistance device for engagement with the linkage system so as to be responsive to movement of the drive lever; the seat including a non-pivoting backrest and a seat base, the seat adapted to substantially support the weight of the exercise machine user, the seat engaged with the linkage system so as to provide an increasingly upward vertical component of motion to the seat when the drive lever is moved by the user; wherein the user's application of muscular force to the drive lever results in the application of a vertical motion resistance force that includes mechanical resistance of the mechanical resistance assembly as well as at least some of the user's weight; wherein the multiplicity of links are configured to maintain the backrest in a non-pivotal orientation to the foot pad such that the user may maintain a substantially horizontal line of leg press force between the foot rest and seat back while operating the machine; and further including a floor support frame wherein the seat is supported by pivotal attachments to the drive lever and wherein the multiplicity of links includes a rocker link, wherein the drive lever and the rocker link are pivotally attached to the floor support frame such that the increasingly vertical upward component of motion of the seat occurs when the drive lever is pivoted away from the user's torso by the limbs of the user further comprising an intermediate link coupled to one end of the drive lever and the seat, the intermediate link pushed by the drive lever and cooperating with the rocker link to elevate the seat, wherein the rocker link has at least one end and is coupled at the end to an intermediate point on the intermediate link.

2. The exercise machine of claim 1, wherein the mechanical resistance device includes one of an hydraulic cylinder, pneumatic cylinder, weights, springs, elastic members or any similar type of resistance device.

3. The exercise machine of claim 1, wherein the mechanical resistance device includes means responsive to a velocity applied thereto to increase the mechanical resistance when said velocity is increased.

4. The exercise machine of claim 1, wherein the back rest and the seat base are rigidly engaged so that the seat back does not move with respect to the seat base.

5. The exercise machine of claim 1, wherein the drive lever includes a generally cylindrical hand bar.

6. The exercise machine of claim 4, further including means to achieve rotation of the foot pad as a function of the drive lever position so as to provide a desired angle between a lower leg and a foot of the user during movement of the drive lever.

7. The exercise machine of claim 4, further including means to adjustably set a preselected angle of the foot pad with respect to the drive lever.

8. The exercise machine of claim 4, further including means to selectively adjust and set the distance between the foot engaging surface of the foot pad and the drive lever.

9. The exercise machine of claim 1, wherein the drive lever further includes means to alter a mechanical advantage thereof.

10. The exercise machine of claim 9, wherein the mechanical resistance device engages the seat link and the frame.

11. The exercise machine of claim 10, further including a bracket assembly to preselectively adjust an angle between the mechanical resistance device and the frame.

12. The exercise machine of claim 9, wherein the mechanical resistance device engages the drive lever and the frame; and wherein the resistive force of the user's weight is substantially de-coupled from direct support by the user's legs.

13. The exercise machine of claim 12, further including a bracket assembly to preselectively adjust an angle between the mechanical resistance device and the frame.

14. The exercise machine of claim 9, wherein the mechanical resistance device engages any two links of the linkage system so as to move in response to a force applied to the drive lever.

15. The exercise machine of claim 9, wherein the seat adjustably engages the seat link to preselectively set the vertical distance of the seat above the support surface.

16. The exercise machine of claim 1, wherein an end of the drive lever distal from the point at which the driver lever pivotally attaches to the floor support frame extends substantially vertical from the support frame and moves away from the user's torso when the drive lever is pivoted away from the user's torso by the limbs of the user.

17. An exercise machine comprising:

a base;

a footplate;

a seat support member, including a seat;

a drive lever having a first end and a second end, the first end for engaging the footplate and extending substantially vertical from the base, the second end for engaging the seat support member, the drive lever engaged with the base between the first and the second end thereof;

a resistance device for engagement with the base and either of the seat support member or the drive lever; and a rocker arm for engagement with the base, which rocker arm will increasingly raise the seat as the user's legs, urging the footplate, extend between the seat and the footplate and move to an extended position;

wherein the user is seated in a non-pivoting sitting position in the seat and the user's application of muscular force to the drive lever results in relative movement of the seat away from the first end of the drive lever and also results in the application of a non-linear resistive force that increases in coordination with increasing joint strength as the limb extends, the resistive force including a mechanical resistance by the mechanical resistance device and a resistance that includes elevating at least some of the user's weight which increases with increasing joint strength as the limb extends; and further including means to engage a footplate to the drive lever to allow the footplate to pivot with respect to the drive lever during an exercise, further including means to selectively set the footplate to move with respect to the drive lever so as to control the rotation of the footpad with respect to the drive lever through the extension of the user's legs.

* * * * *